US006692384B2

(12) United States Patent
Bains

(10) Patent No.: US 6,692,384 B2
(45) Date of Patent: Feb. 17, 2004

(54) APPARATUS FOR DEFINING GOAL TARGET AREA

(76) Inventor: Shelley Bains, P.O. Box 17935, Richmond, VA (US) 23228

( * ) Notice: Subject to any disclaimer, the term of this patent is extended or adjusted under 35 U.S.C. 154(b) by 0 days.

(21) Appl. No.: 10/162,578

(22) Filed: Jun. 6, 2002

(65) Prior Publication Data

US 2003/0228941 A1 Dec. 11, 2003

(51) Int. Cl.[7] ..... A63B 69/00
(52) U.S. Cl. ..... 473/446
(58) Field of Search ..... 473/446, 400, 473/406, 197, 422, 439, 454, FOR 212; D21/699

(56) References Cited

U.S. PATENT DOCUMENTS

| | | | | |
|---|---|---|---|---|
| 2,932,516 A | | 4/1960 | Penner | |
| 2,978,246 A | | 4/1961 | van Groningen | |
| 3,197,208 A | | 7/1965 | Makar | |
| 3,583,703 A | | 6/1971 | Brown | |
| 3,709,489 A | | 1/1973 | Holleran et al. | |
| 3,840,228 A | | 10/1974 | Greaney | |
| 3,887,181 A | | 6/1975 | Samaras | |
| 4,068,846 A | | 1/1978 | Forrest | |
| D250,283 S | | 11/1978 | Norton | |
| 4,188,031 A | | 2/1980 | Fox | |
| 4,245,843 A | | 1/1981 | Griggs | |
| 4,286,786 A | | 9/1981 | Papadopoulos | |
| 4,295,648 A | | 10/1981 | Stromback | |
| 4,344,621 A | | 8/1982 | Baker | |
| 4,783,070 A | | 11/1988 | Bauer et al. | |
| 4,842,283 A | | 6/1989 | LeBel et al. | |
| 4,921,257 A | * | 5/1990 | Heller | 473/446 |
| 4,932,657 A | | 6/1990 | Haller et al. | |
| 4,948,147 A | | 8/1990 | Pallanca | |
| 5,181,725 A | | 1/1993 | Leras et al. | |
| 5,197,744 A | | 3/1993 | Nanau | |
| 5,271,624 A | | 12/1993 | Sciortino | |
| 5,330,199 A | | 7/1994 | Vand | |
| 5,433,434 A | | 7/1995 | Helmetsie | |
| 5,503,402 A | * | 4/1996 | Moss, Jr. | 273/400 |
| 5,516,115 A | | 5/1996 | McLain | |
| 5,628,515 A | | 5/1997 | Levy | |
| 5,634,640 A | | 6/1997 | McCarrel | |
| 5,704,855 A | * | 1/1998 | Kellogg, Jr. | 473/422 |
| 5,888,153 A | | 3/1999 | Masin | |

FOREIGN PATENT DOCUMENTS

| | | |
|---|---|---|
| DK | 4135941 | 5/1993 |
| GB | 190859 | 1/1923 |
| GB | 224072 | 11/1924 |
| RU | 1771777 | 10/1992 |

* cited by examiner

*Primary Examiner*—Stephen Blau
*Assistant Examiner*—M. Chambers
(74) *Attorney, Agent, or Firm*—Nixon & Vanderhye, P.C.; Frank P. Presta

(57) ABSTRACT

Apparatus for defining a target area in the corner of a goal formed by a goal cross bar and a goal upright post, comprising first and second elongated tubular frame members slidably connected together in telescoping relation so that the overall length thereof can be varied. Connector members are secured to the outer ends of the first and second frame members to enable them to be removably connected respectively by flexible straps or the like to the adjacent portions of the goal cross bar and the goal upright post to define the target area.

15 Claims, 8 Drawing Sheets

APPARATUS FOR DEFINING GOAL TARGET AREA

BACKGROUND OF THE INVENTION

The present invention relates to portable apparatus for defining a goal target area and, more specifically, to such apparatus that can be removably attached to the top cross bar and adjacent vertical post of a goal for a sport such as soccer, hockey, lacrosse or the like, for the purpose of defining a target area in the upper corner of the goal.

In sports such as soccer, hockey, lacrosse or the like, strategically placed goals, particularly in the upper corner of the goal area, are usually impossible or difficult for the goal-keeper to block. This makes it highly desirable to train players to shoot for the upper corners of the goal area. Providing players with the visual isolation of these areas of the goal enhances the chance for successful goals. It is a common mistake for beginning players (usually children) to shoot the ball at the goal-keeper rather than around the goal-keeper. The target area defining apparatus of the present invention is portable, adjustable and can be easily removably attached to the top bar and adjacent post of a goal to define a target area of desired size in the upper corner of the goal for players to shoot at in practice with or without a goal-keeper in the goal area.

SUMMARY OF THE INVENTION

The target area defining apparatus of the present invention comprises a pair of elongated tubular frame members that are slidably connected at their inner ends in telescoping relation so that the overall length of the frame members can be adjusted. The outer end of each frame member has connected thereto in fixed or movable relation a fitting for enabling the outer end of the frame member to be removably connected to the adjacent portion of the top horizontal cross bar or vertical post of the goal.

In one embodiment, the connection fittings at the outer ends of the tubular members are constructed to receive therethrough an attachment strap or the like for the purpose of attaching the fittings and thus the ends of the tubular members to the adjacent portions of the cross bar and vertical post of the goal. The attachment straps may be tied to the goal cross bar and post or may be provided with suitable means for enabling them to be removably connected thereto, such as hook and loop fasteners, or other fasteners.

In operation, the length of the tubular members is adjusted so that they extend across an upper corner of the goal area to define a target area of desired size in the upper corner for players to shoot at. The attachment straps extending through the connector fittings are then secured to the adjacent portions of the goal cross bar and vertical post to removably secure the target area defining apparatus to the goal. The size of the target area can be easily adjusted by removing the attachment straps from the goal and adjusting the relative telescoping positions of the tubular members.

Also, the target area defining apparatus of the present invention can be easily removed from the goal by removing the attachment straps therefrom and then moving the tubular members inwardly into retracted telescoping relation so that the overall apparatus is at a minimum size for storage or the like. The tubular members and connector fittings of the present apparatus may be formed of any suitable impact resistant material such as metal or plastic. The telescoping tubular members may be provided with a suitable detent mechanism or the like for the purpose of removably retaining them in desired telescoping positions relative to each other.

DESCRIPTION OF THE PREFERRED EMBODIMENTS

Figure 1:
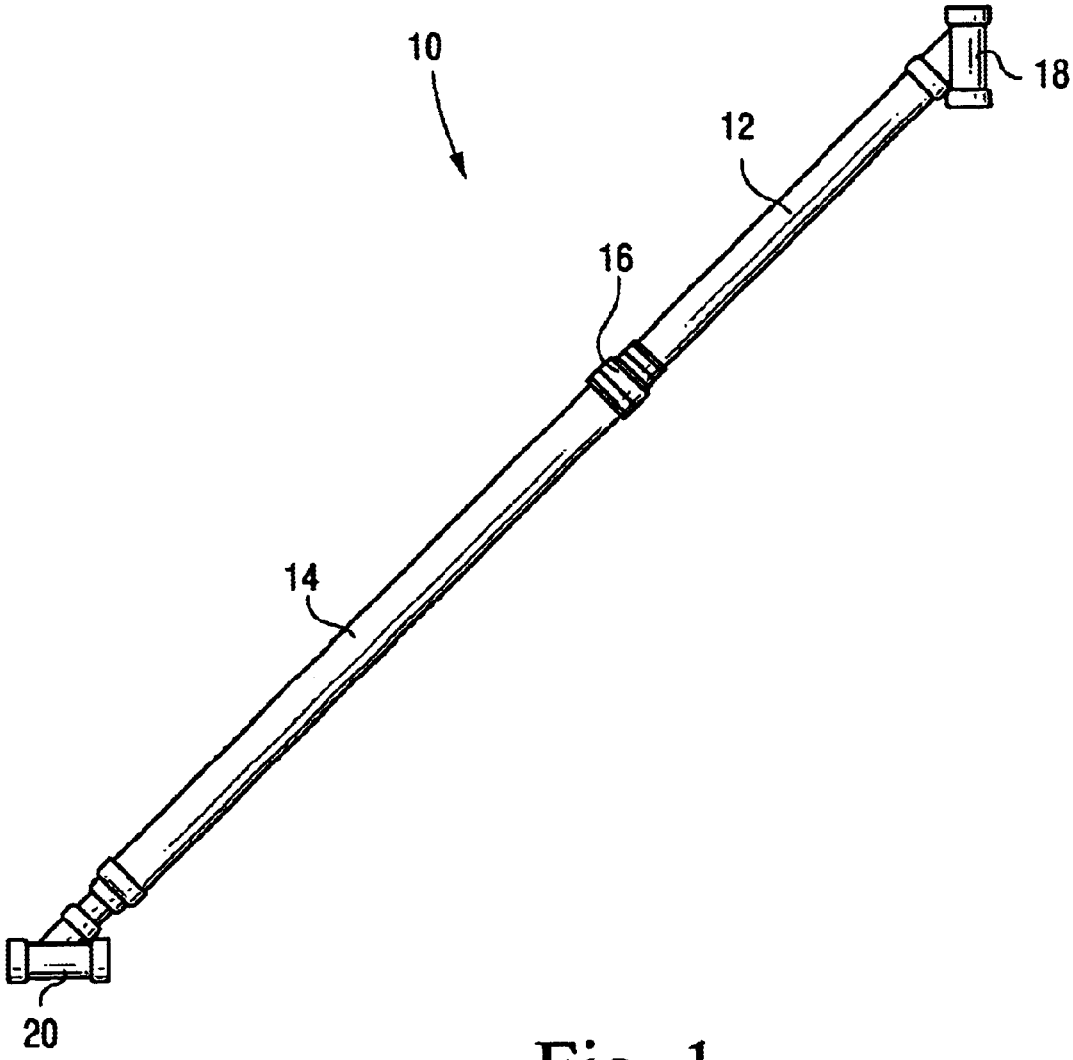
FIG. 1 is a side elevational view of the target area defining apparatus of the present invention, showing the tubular members in telescopically extended positions.

FIG. 1 illustrates the target area defining apparatus 10 of the present invention, which comprises a pair of elongated tubular frame members 12, 14 that are slidably connected together at a telescoping joint 16 such that the smaller frame member 12 can be moved into or out of the larger frame member 14 for the purpose of adjusting the overall length of the frame members.

Connector members or fittings 18, 20 of any suitable construction or operation are secured to the outer ends of the frame members 12, 14 respectively. In the embodiment shown in FIG. 1, the connector fittings 18 and 20 are tubular and are fixedly connected to the outer ends of the frame members. Within the scope of the present invention, the connector members 18, 20 could be movably or rotatably connected to the outer ends of the frame members in any suitable manner.

The frame members 12, 14 and connector members 18, 20 may be formed of any suitable impact-resistant material, such as metal or plastic.

Figure 2:
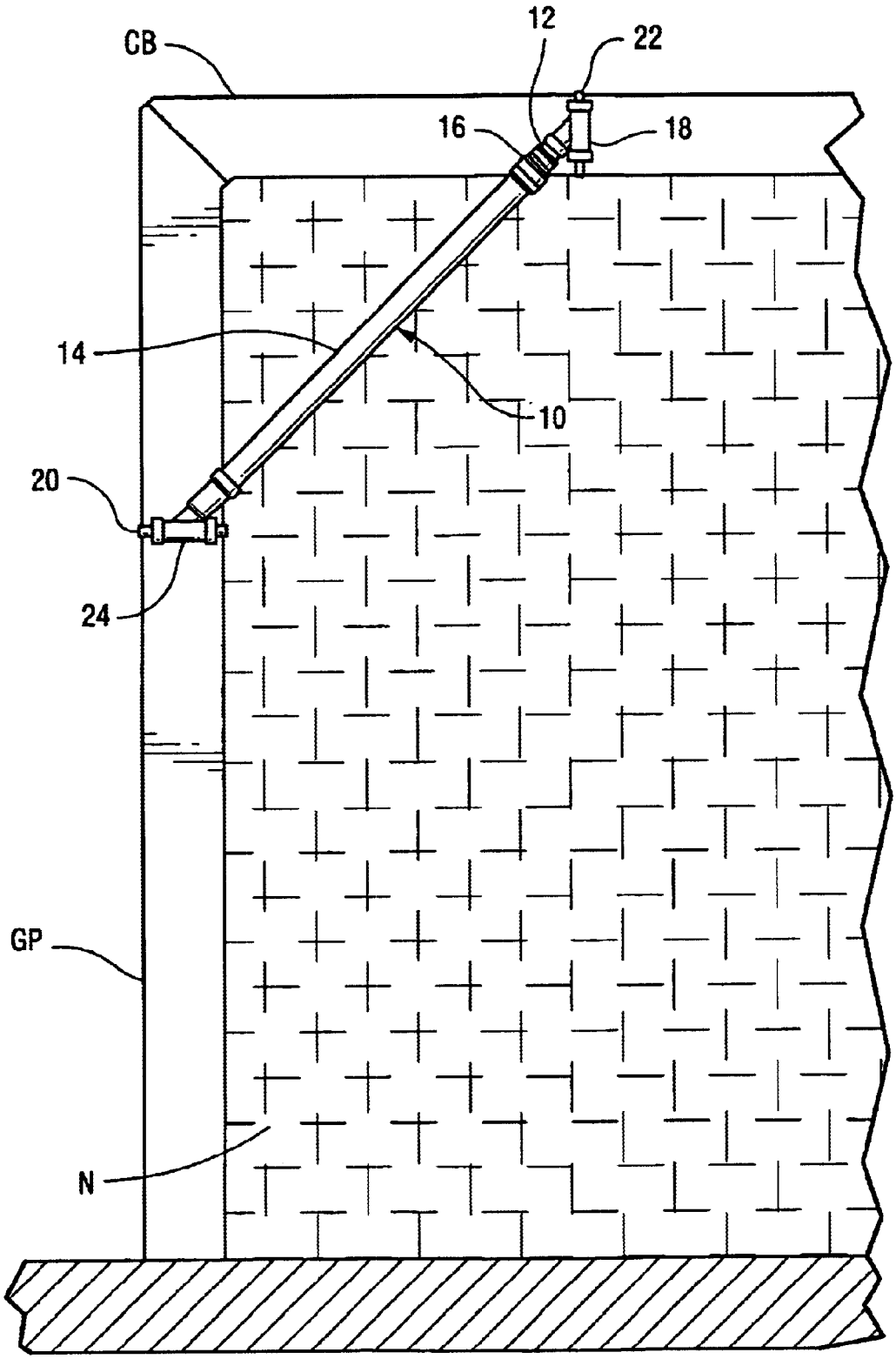
FIG. 2 is a side elevational view of the target area defining apparatus mounted on the upper corner of a goal, with the tubular frame members in a substantially fully retracted position for the purpose of defining a small target area in the upper corner of the goal.
Figure 3:
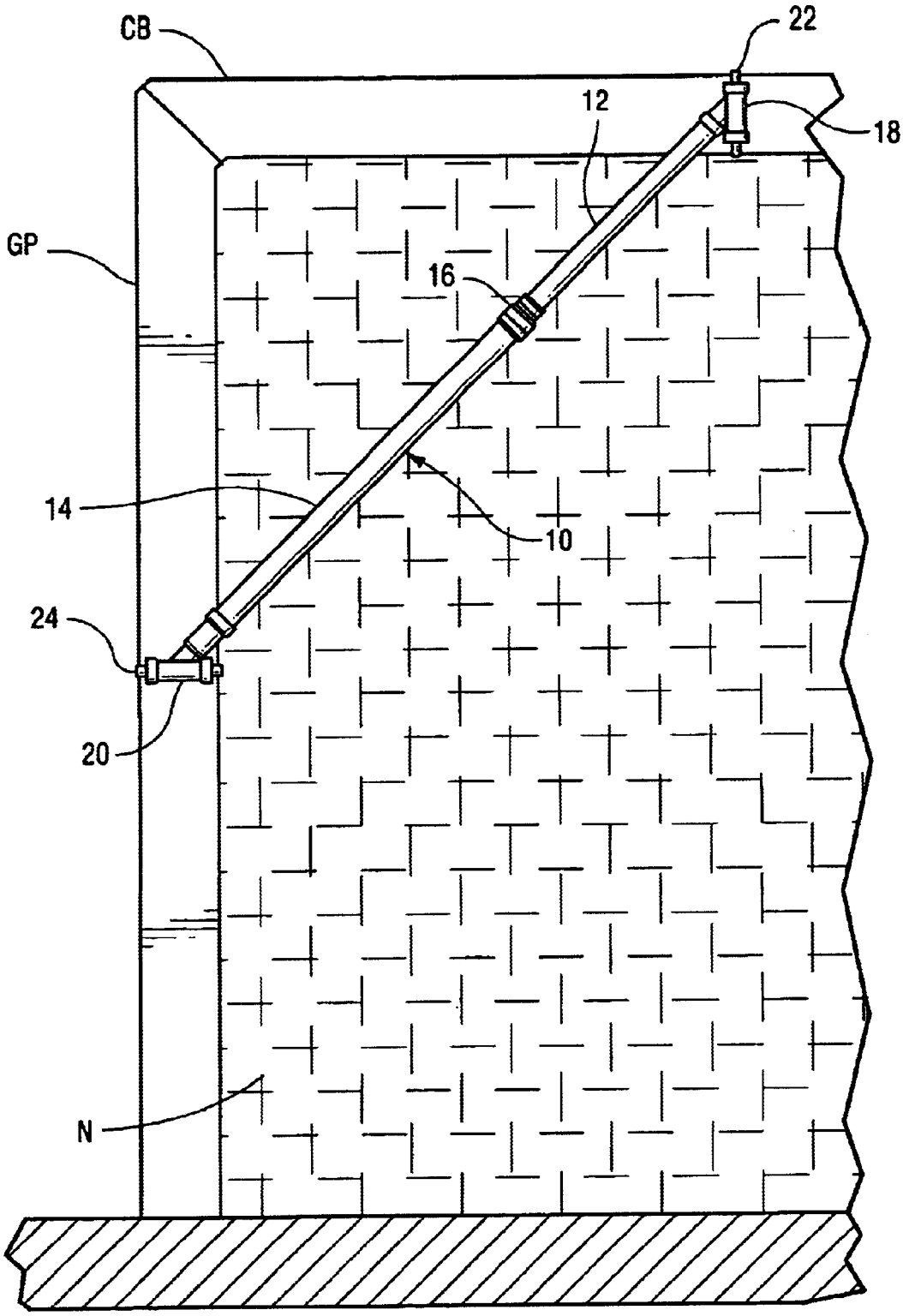
FIG. 3 is a view similar to FIG. 2 wherein the tubular frame members are in telescopically extended positions relative to each other to define a larger target area in the upper corner of the goal.

FIGS. 2 and 3 illustrate the target area defining apparatus 10 removably mounted on a goal, such as a soccer goal, to define goal target areas of different size in the upper corner of the goal. As shown in FIG. 2, flexible attachment straps 22 and 24 extend through the tubular connector fittings 18 and 20, respectively. The attachment strap 22 extends around the cross bar CB of the goal and is removably secured thereto in any suitable manner, such as being tied or secured thereon, or through a suitable cross bar connection. Similarly, the flexible strap 24 extends through the connector fitting 20 and is secured to the adjacent portion of the vertical goal post GP in any suitable manner such as being tied or secured thereon, or by a suitable post connection.

In FIG. 2, the tubular frame members 12, 14 are in retracted telescoping positions to shorten the overall length thereof and to define a small target area in the upper corner of the goal. In FIG. 3, the tubular frame members 12, 14 are in extended telescoping positions to provide a larger overall length thereof to define a larger target area in the upper corner of the goal.

Figure 4:
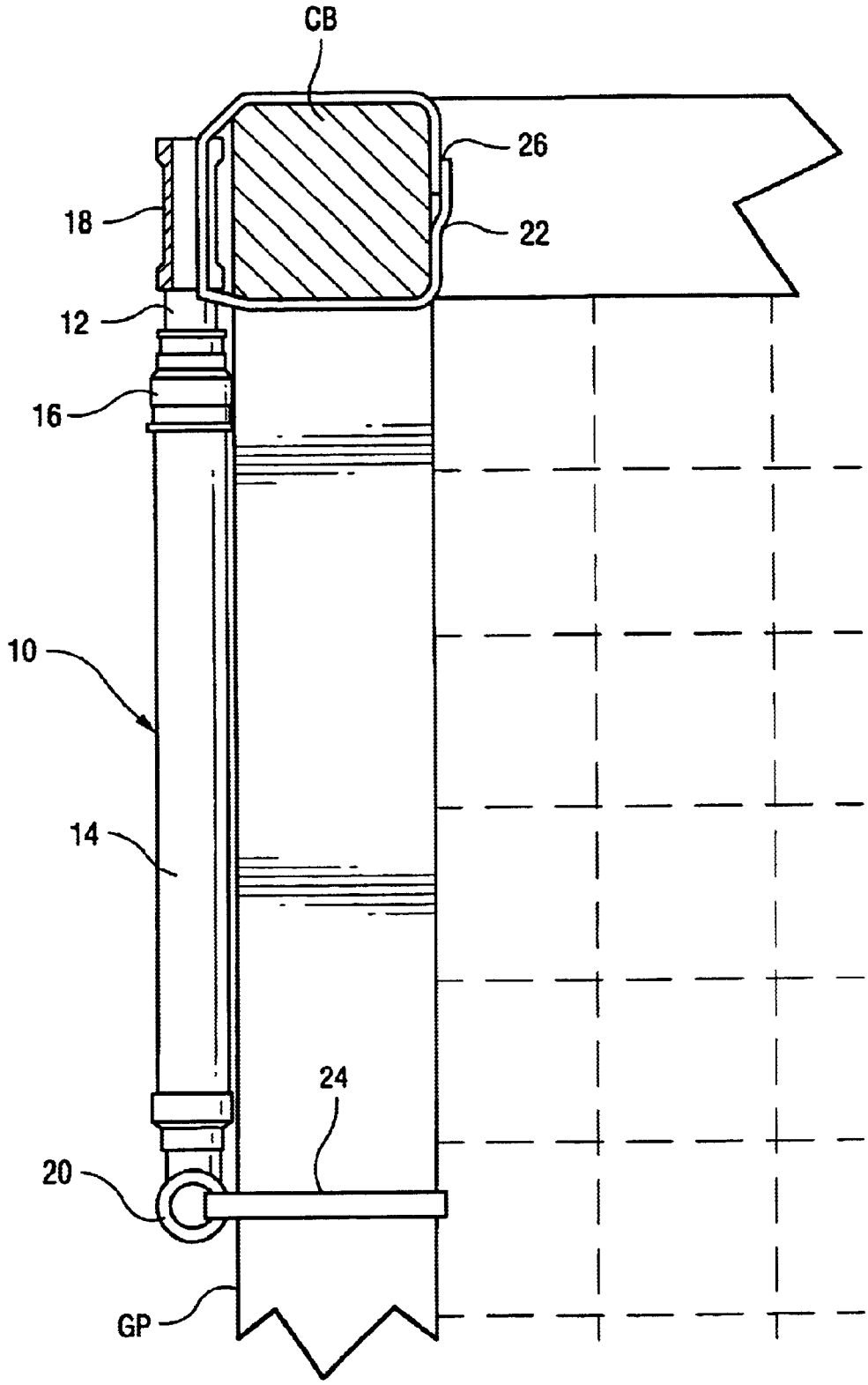
FIG. 4 is an enlarged end view, partly in section, showing the target area defining apparatus secured to a top cross bar and adjacent vertical post of the goal by attachment straps.

As shown in FIG. 4, the flexible straps 22 and 24 extend around the cross bar CB and goal post GP, respectively, to removably connect the target are defining apparatus 10 thereto. The straps 22 and 24 may be overlapped and secured together around the goal by a connection such as a hook and loop fastener connection 26, as shown with respect to the strap 22, or by any other suitable type of connection. The straps 22, 24 may be formed of any suitable weather-resistant, strong material such as nylon or the like.

Figure 5:
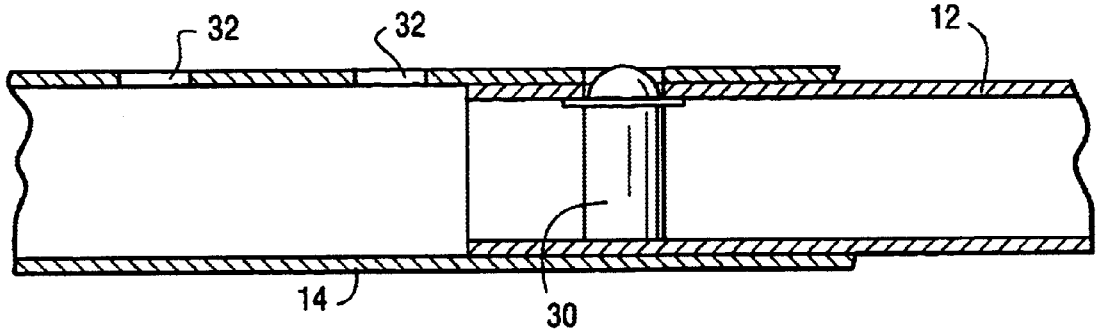
FIG. 5 is an enlarged sectional view of the inner portions of the tubular frame members in telescoping relation, showing one form of detent mechanism for removably retaining them in different adjusted positions relative to each other.

The tubular frame members 12, 14 may be provided with any suitable type of mechanism, such as a detent mechanism, for removably retaining them in different telescopic positions relative to each other. As shown in FIG. 5, the inner frame member 12 may be provided with a spring-biased ball detent member 30 which is adapted to be removably received in one of the spaced apertures 32 in the outer tubular frame member 14 for the purpose of removably retaining the frame members 12 and 14 in different relative telescoping positions to vary the overall length thereof. By applying inward or outward pressure on the frame members 12, 14, the ball detent member 30 may be moved out of a respective aperture 32 and into another one to change the positions of the frame members relative to each other.

Figure 6:
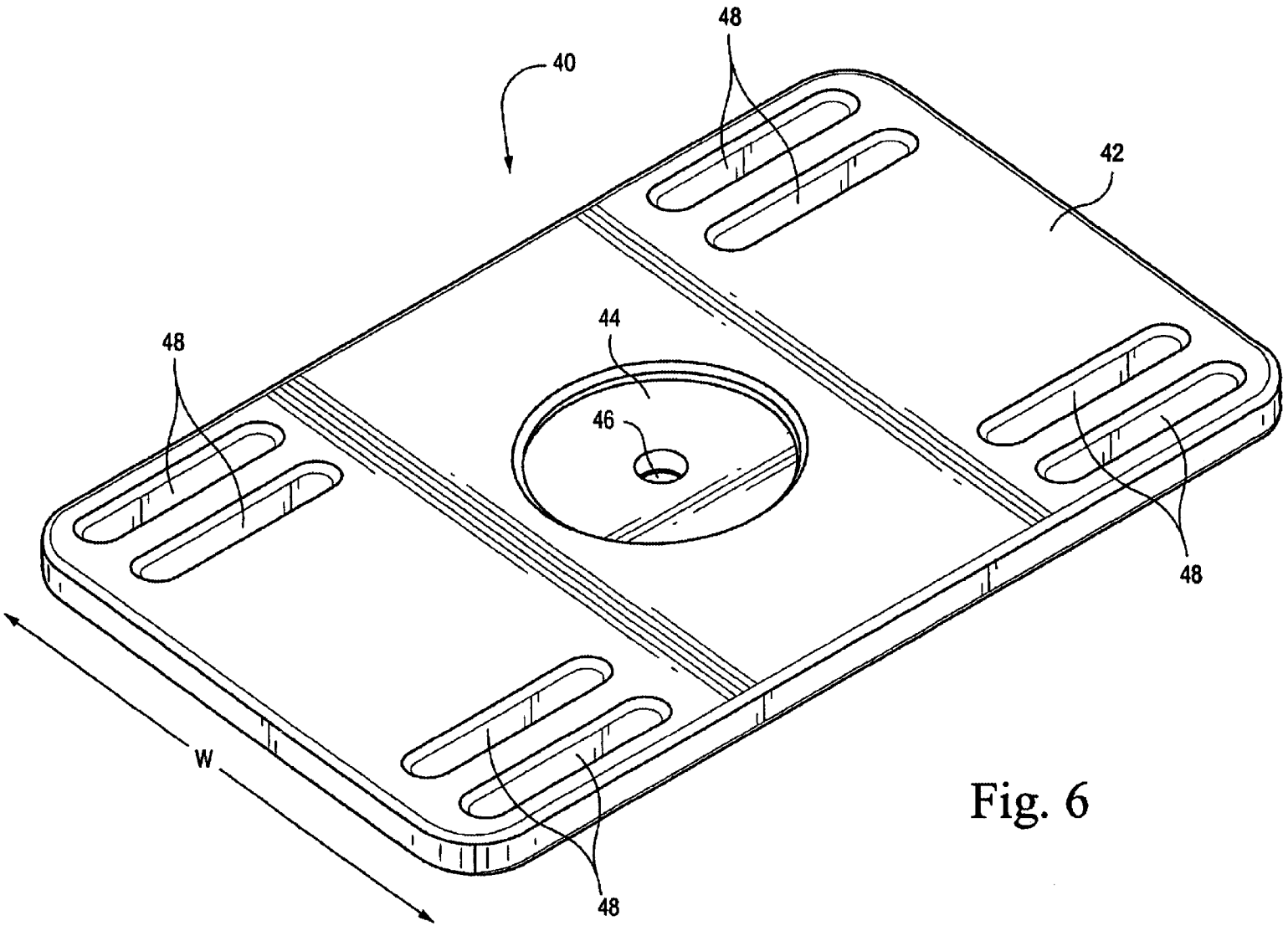
FIG. 6 is a perspective view of a second embodiment of a connector member for enabling the tubular members to be connected to a goal.

FIG. 6 illustrates a second embodiment of a connector member 40 to be secured to the outer ends of the tubular frame members 12, 14 to enable them to be removably secured to a goal to define a target area thereon. The connector member 40 comprises a relatively flat body portion 42 having a height or width that is similar to or less than that of a cross bar or goal post on which it is to be mounted. The body portion 42 comprises a central, generally circular recessed area 44 having an aperture 46 in the center thereof extending through the body portion 42.

The corners of the body portion 42 are provided with a plurality of elongated slots 48 extending through the body portion to enable flexible straps (not shown) or the like to be extended through the slots on both sides of the body portion 42 for the purpose of removably securing the connector member 40 to the adjacent portion of a cross bar or vertical post of a goal.

The central aperture 46 in the body portion 42 is for the purpose of enabling the connector member 40 to be secured to the outer end portion of the tubular frame member 12 or 14, and the recessed central portion 44 is for the purpose of allowing the body portion 42 to be rotatably secured to the outer end portion of the frame member 12 or 14, as further described hereinafter.

Figure 7:
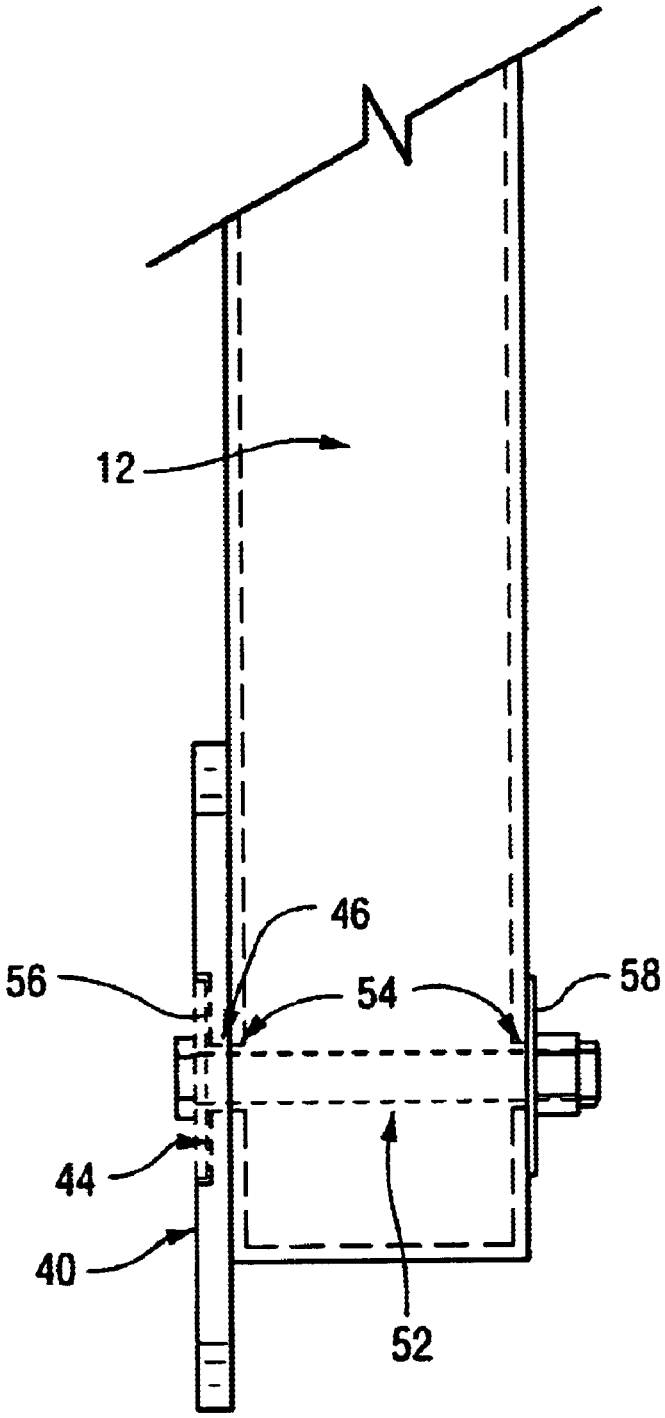
FIG. 7 is a side view of one end of a tubular frame member showing the connector fitting of FIG. 6 connected thereto and to an adjacent goal.

As shown in FIG. 7, the outer end portion of the tubular frame member 12 is secured to the connector member 40 by a bolt 52 that extends through aligned apertures 54 in the frame member 12 and through the aperture 46 in the connector member 40. A washer 56 is received in the recessed area 44 of the connector member 40, and a second washer 58 is positioned on the bolt 52 adjacent the opposite side of the frame member 12 for the purpose of facilitating the rotation of the connector member 40 relative to the outer end of the frame member 12. Another connector member 40 (not shown) is secured to the outer end of the other tubular member 14 in the same manner.

Figure 8:
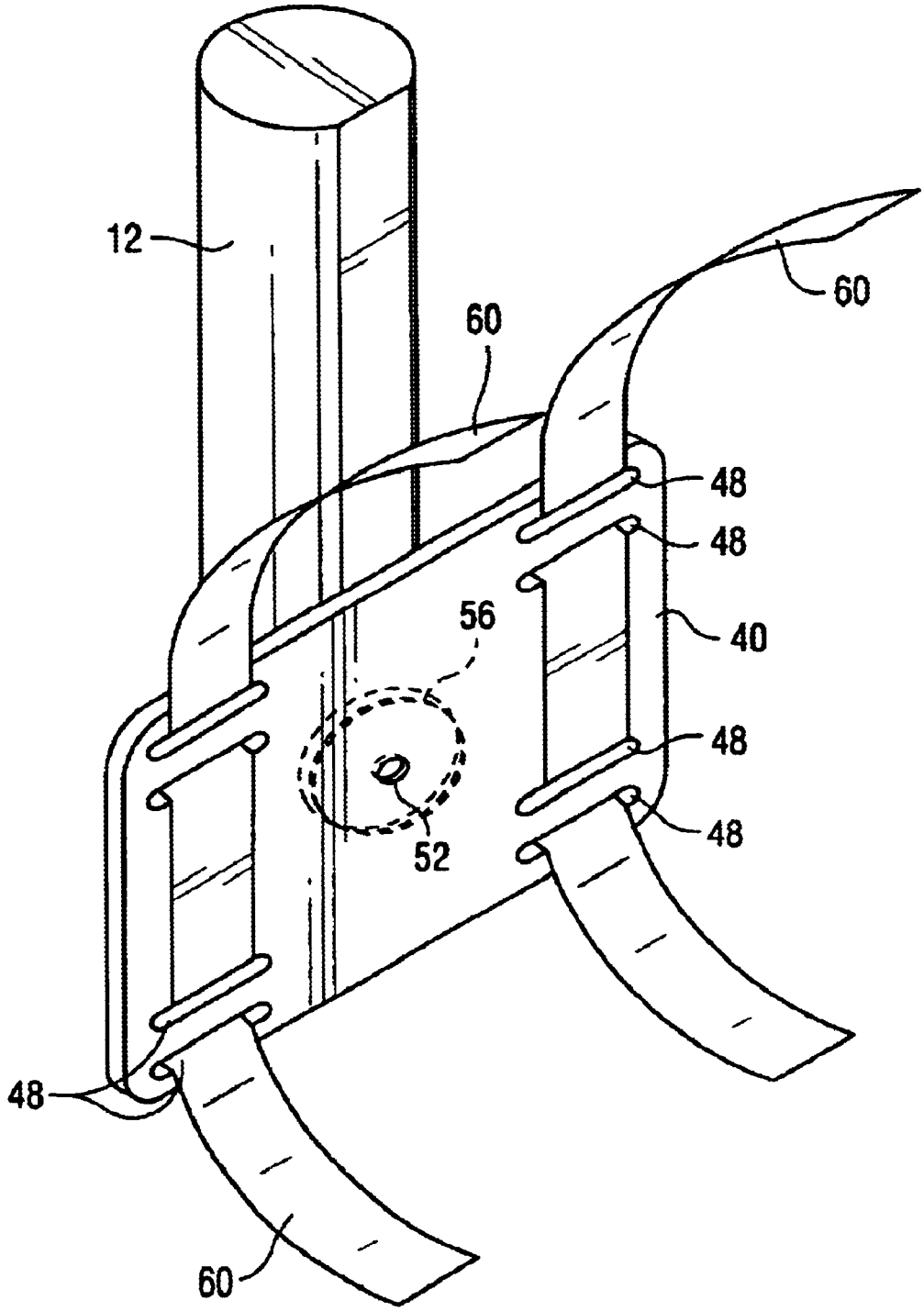
FIG. 8 is a perspective view, with some parts omitted, of the connector fitting of FIG. 6 and the attached tubular frame member.

FIG. 8 illustrates a pair of flexible straps 60 extending through the slots 48 of the connector member 40 to secure it and the attached end of the tubular frame member 12 to the adjacent portion of a cross bar CB of a goal in a manner similar to that of the first embodiment shown in FIGS. 2, 3 and 4.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. Apparatus for defining a target area in the corner of a goal, said apparatus comprising:

a goal having a cross bar and an upright post;

first and second elongated tubular frame members movably connected together in substantially longitudinally aligned, telescoping relation so that the overall length thereof can be varied; and connector members secured to die outer ends of said first and second frame members and being removably connected respectively to the adjacent portions of said goal cross bar and said goal upright post to define the target area.

2. The apparatus of claim 1 wherein said connector members are fixably secured to said first and second frame members.

3. The apparatus of claim 1 wherein said connector members are rotatably secured to said first and second frame members.

4. The apparatus of claim 3 wherein said connector members are provided with slots therethrough that are adapted to receive flexible straps therethrough for the purpose of removably connecting said connector members to said goal cross bar and said goal upright post.

5. The apparatus of claim 4 wherein each of said connector members has a central recessed portion and a central aperture therethrough, and the outer ends of said first and second frame members are each rotatably connected to said connector members by a bolt having a washer thereon that is rotatably mounted in said recessed circular portion of said connector members to facilitate the rotation of said connector members relative to said frame members, and said frame members have apertures therethrough in alignment with the central apertures of said connector members, said bolts extending through said aligned apertures of said connector members and said frame members to rotatably secure them together.

6. The apparatus of claim 1 wherein said connector members have apertures therethrough, and flexible straps extend through said apertures to secure said connector members and said first and second frame members to said goal cross bar and said goal upright post.

7. The apparatus of claim 6 wherein said flexible straps are constructed with hook and loop-type connectors at the ends thereof for the purpose of enabling them to be removably secured to a goal cross bar or a goal upright post.

8. The apparatus of claim 1 wherein said first frame member extends Into said second frame member in telescoping relation.

9. The apparatus of claim 8 wherein said first frame member is provided with a detent mechanism, and said second frame member is provided with a plurality of longitudinally spaced apertures adapted to removably receive said detent member therein for the purpose of removably retaining said first and second frame members in different telescoping positions relative to each other.

10. The apparatus of claim 9 wherein said detent is a ball detent.

11. The apparatus of claim 1 wherein said frame members are slidably connected together.

12. A method for defining a target area in the corner of a goal formed by a goal cross bar and a goal upright post, comprising:

providing first and second elongated tubular frame members movably connected together in substantially longitudinally aligned, telescoping relation so that the overall length thereof can be varied; and securing the outer ends of said frame members to the adjacent portions of a goal cross bar and a goal upright post to define the target area.

13. The method of claim 12 wherein the outer ends of said frame members are removably secured to the goal cross bar and the goal upright post.

14. The method of claim 13 wherein the outer ends of said frame members are removably secured to the goal cross bar and goal upright post by flexible straps.

15. The method of claim 12 wherein said frame members are slidably connected together.

* * * * *